US006227760B1

(12) United States Patent
Togami et al.

(10) Patent No.: US 6,227,760 B1
(45) Date of Patent: May 8, 2001

(54) TRAVEL CONTROL DEVICE FOR VIBRATING PLATE COMPACTOR

(75) Inventors: Takashi Togami; Giichi Tanaka; Hideki Mochiki, all of Saitama-Ken (JP)

(73) Assignee: Mikasa Sangyo Co., Ltd., Tokyo (JP)

( * ) Notice: Subject to any disclaimer, the term of this patent is extended or adjusted under 35 U.S.C. 154(b) by 0 days.

(21) Appl. No.: 09/243,695

(22) Filed: Feb. 3, 1999

(30) Foreign Application Priority Data

Feb. 6, 1998 (JP) ..... 10-039846
May 13, 1998 (JP) ..... 10-146663

(51) Int. Cl.[7] ..... E01C 23/07

(52) U.S. Cl. ..... 404/84.1; 404/102; 404/113; 404/120; 404/133.05; 74/61

(58) Field of Search ..... 404/84.1, 102, 404/113, 114, 118, 133.05; 405/271; 74/61; 91/433; 366/128

(56) References Cited

U.S. PATENT DOCUMENTS

| | | | | |
|---|---|---|---|---|
| 3,814,533 | * | 6/1974 | Buck | 404/133 |
| 4,356,736 | | 11/1982 | Riedl . | |
| 4,389,137 | * | 6/1983 | Riedl | 404/113 |
| 4,771,645 | | 9/1988 | Persson . | |
| 5,177,386 | * | 1/1993 | Shimada | 310/81 |
| 5,410,879 | * | 5/1995 | Houze | 60/469 |
| 5,672,027 | * | 9/1997 | Wadensten | 404/133.05 |

FOREIGN PATENT DOCUMENTS

| | | |
|---|---|---|
| 55-139884 | 11/1980 | (JP) . |
| 63-60306 | 3/1988 | (JP) . |
| 1-260107 | 10/1989 | (JP) . |
| 7-286306 | 10/1995 | (JP) . |

* cited by examiner

*Primary Examiner*—Eileen D. Lillis
*Assistant Examiner*—Gary S. Hartmann
(74) *Attorney, Agent, or Firm*—Frishauf, Holtz, Goodman, Langer & Chick, P.C.

(57) ABSTRACT

A travel control device for vibrating plate compactor which can easily switch the travel direction of a large sized compactor weighing more than 500 kg by a hydraulic pump circuit having a servo valve to supply pressure from outside for switching the travel direction in order to shift the rotational phase of one of the rotors in the vibration generator. The travel control device receives the mechanical return force from the vibration generator at one end thereof in the cylindrical body and is provided at other end with a piston positioned to receive the pressure oil from an outside hydraulic pump, a push rod to operate said piston inserted into the other end of the body from outside, and a spool for servo valve at the side opposite to the side receiving said mechanical return force of said piston to supply the pressure oil from said hydraulic pump by operating said push rod. By moving the spool lightly for a short distance via said push rod, the pressure oil from the hydraulic pump is supplied to the side opposite the piston receiving the mechanical return force from the vibration generator, and the advancing force to resist the mechanical return force is imparted to the vibration generator.

8 Claims, 14 Drawing Sheets

TRAVEL CONTROL DEVICE FOR VIBRATING PLATE COMPACTOR

BACKGROUND OF THE INVENTION AND RELATED ART STATEMENT

This invention is related to a travel control device for a vibrating plate compactor used for compacting paved road surfaces, and more particularly to a travel control device for a vibrating plate compactor wherein the rotational phase of one of two eccentric rotors rotating on a pair of parallel axes is changed relative to another eccentric rotor and the compactor is moved forward/backward by the synthesized vector thereof.

This type vibrating plate compactor generally known in the prior art has a pair of eccentric rotors, the rotational phase of one rotor being variable relative to the other rotor and its vector moving the device forward or backward. A device which uses hydraulic pressure to switch the travel direction forward or backward in order to change the rotational phase of an eccentric rotor is known from prior references such as Japanese Patent Kokai Nos. Sho 55/139884, Sho 63/60306, Hei 1/260107, and Hei 7/286306.

These known compactors are all provided with a spiral groove inside the driven gear on the driven shaft which is rotated by the drive shaft, and a piston rod having a pin to engage with the spiral groove of said driven gear inside said driven shaft. Common to these devices is the way in which the driven gear having the spiral groove is rotated by moving the piston rod in the axial direction and varying the rotational phase of the eccentric rotor on the driven shaft relative to the eccentric rotor on the drive shaft.

Among such compactors, that of Japanese Patent Kokai Sho 55/139884 is provided with a cylindrical driven gear and a piston rod and imparted the mechanical return force moving to one side of the cylindrical driven shaft on the piston rod by synthetic thrust of the rotor on the driven shaft and the rotor on the drive shaft imparts. The hydraulic pressure resisting the mechanical return force of the piston rod is applied from an outside source into the cylinder provided at one end of the cylindrical driven shaft, and by variably controlling the hydraulic pressure supplied, the position of the rotational angle of the driven gear can be selected to suitably change the phase of the eccentric rotor.

However, since a hand-held pump is used as a means to supply the oil into the cylinder provided at one end of the cylindrical driven shaft from the outside source to resist the mechanical return force trying to move toward one side of the cylinder of the piston rod in this conventional compactor, this type device requires large force to manually switch the pump to the opposite side from the position of the piston rod traveling with the fastest speed forward or backward against the largest mechanical return force. In large, heavy weight compactors, the switching operation becomes so heavy that it is impossible to operate the machine.

The compactor according to Japanese Patent Kokai Hei 1/260107 is provided with piston rods which can maintain the neutral state by springs on both sides inside the driven shaft, pistons and cylinders on both sides of the piston rod, connecting the cylinders and the outside pressure source to charge the pressure oil to one of the cylinders from the outside source to move the piston rod. This compactor is also problematic in that the hand-operated pump used for supplying pressure into respective cylinders requires large force and the switching operation is so heavy that heavy weight compactors cannot be used.

On the other hand, the compactor according to Japanese Patent Kokai Sho 63/60306 is provided with a piston and a cylinder at one end of the piston rod inside the driven shaft, and the cylinder is connected to a three-way switch valve in the direction of forward, backward and neutral positions and a hydraulic pump circuit to always return these valves to the neutral position by the spring force. The pressure of this hydraulic pump is used to supply pressure to the cylinder via the valves on the forward and backward sides. While this compactor is advantageous in that the switching operation requires small force and the speed can be controlled by the pressure oil charged to the cylinder at one end of the piston rod by the hydraulic pump, it is quite defective in that the switch valve always returns to the neutral position by the spring force. It is therefore impossible to hold the travel lever at a desired inclined position.

The compactor according to Japanese Patent Kokai Hei 7/286306 is similar to the compactor disclosed in Japanese Patent Kokai Hei 1/260107 in that is provided with a piston rod maintained neutral by springs on both sides in the driven shaft, and pistons and cylinders are respectively provided at both ends of the piston rod. A hydraulic pump circuit provided with a three-way valve which can be switched to the forward, backward and neutral directions is connected to both cylinders as an outside source to supply the oil from the valve to respective cylinders in order to switch the piston rod to any one of the three directions.

Although this compactor can reduce the force needed for switching because oil is supplied to cylinders at both ends of the piston rod by the hydraulic pump, all the oil from the pump is fed by switching the valve to the forward or backward directions to thereby set the fastest running speed in these directions. It is therefore impossible to set the running speed at an arbitrary speed.

SUMMARY OF THE INVENTION

This invention was contrived in view of the problems discussed above in the conventional type vibrating plate compactors. More concretely, the invention aims to offer a novel vibrating plate compactor which can set the travel lever at an arbitrary position between the fastest forward speed and the fastest backward speed for traveling the compactor at a desired speed even when the compactor is heavier than 500 kg by using a hydraulic pump circuit provided with a servo function as an outside pressure source for the piston rod to change the rotational phase of one of the eccentric rotors in a vibrating plate generator.

In a vibrating plate compactor provided with an eccentric rotor on one of the two parallel axes connected to each other of which rotor can vary the rotational phase of the eccentric rotor on the other axis, a piston rod inserted slidably into the shaft of the eccentric rotor for changing the phase of said eccentric rotor, and a vibration generator having a hydraulic cylinder at one end of the axis of the piston rod to switch the rotation of rotors in the forward and backward directions by moving the piston rod axially by the hydraulic pressure resisting the mechanical return force generated by the rotation of the eccentric rotor, the travel control device for the vibrating plate compactor according to the present invention is characterized by the provision of a piston to receive at one end thereof the mechanical return force applied from the direction of the piston rod inside the cylindrical body, and a servo valve mechanism to supply oil from a hydraulic pump outside the body to the other end of the piston to resist the mechanical return force from the direction of the piston rod.

Said travel control device is preferably provided with a piston at one end of the cylindrical body to receive at one end thereof the mechanical return force from the direction of the said piston rod, a push rod for switching the travel direction between forward and backward directions at the other end of said body, a spool for the servo valve mechanism at the center of the said body to charge oil from the hydraulic pump positioned outside the body to the other end of the piston in order to resist the mechanical return force, and springs respectively between said piston and said push rod.

Between the spool at the center of the body and the inside of the piston is provided a passage for the pressure oil on the side of the vibration generator to guide the oil into the piston as a mechanical return force is applied from the direction of the piston rod of the vibration generator, and between said spool and the outside of the piston is provided another passage on the pump side to supply oil from the hydraulic pump outside the body to the outside of said piston to resist said mechanical return force.

The body supporting said spool is preferably constructed by providing a first passage to supply oil from the hydraulic pump to the outside of the piston via a concave groove cut on the outer periphery of the spool as the spool travels laterally by operation of the push rod, and a second passage on the tank side to send oil returned from the outside of said piston through said first passage to the tank via another concave groove cut on the outer periphery of the spool.

DETAILED DESCRIPTION OF THE PREFERRED EMBODIMENTS

Figure 1:
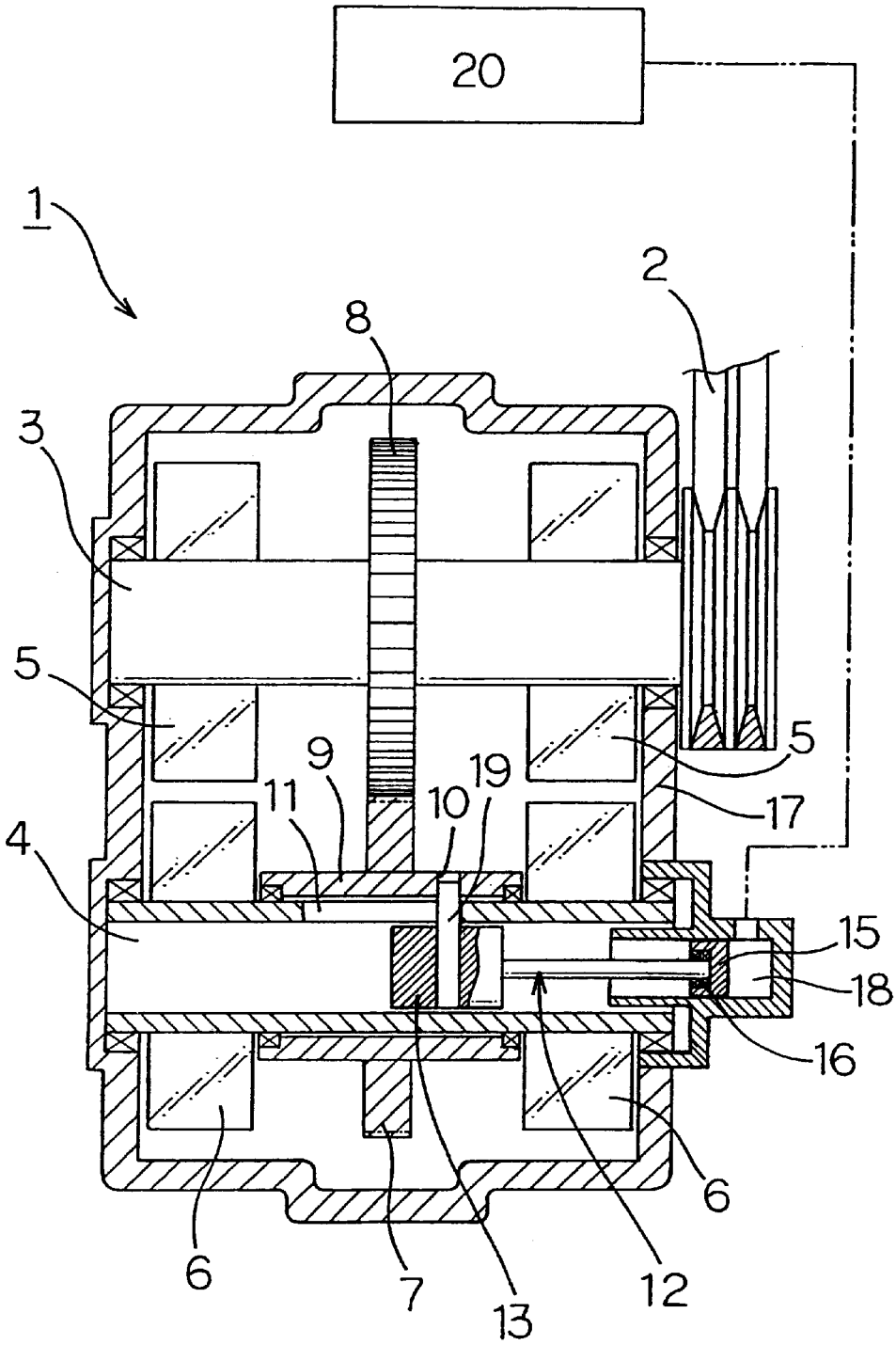
FIG. 1 is a sectional view to show the construction of a vibration generator in the vibrating plate compactor according to the present invention.
Figure 2:
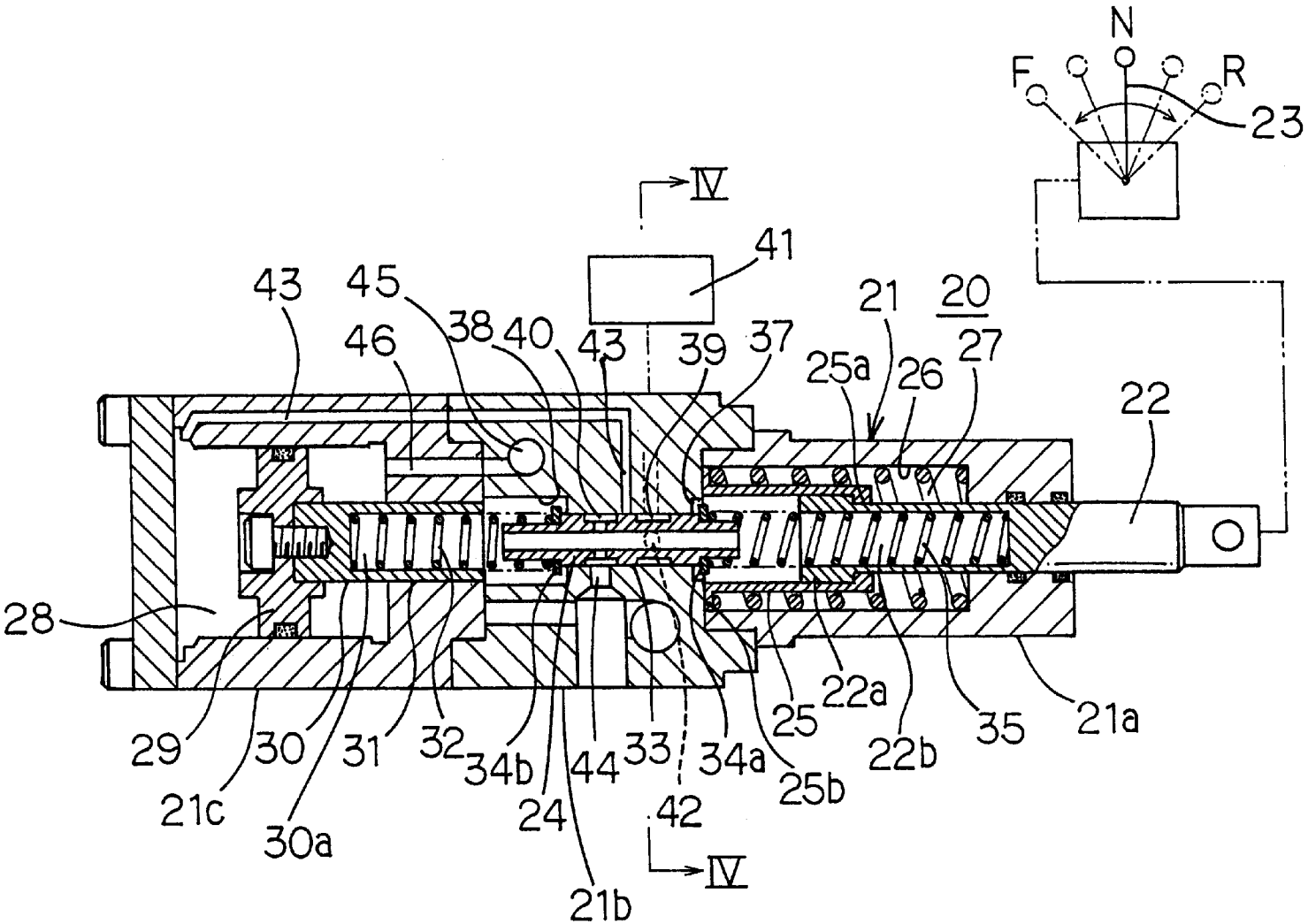
FIG. 2 is a sectional view to show the construction of the travel control device in the vibrating plate compactor according to the present invention.

Referring to embodiments of the vibrating plate compactor according to the present invention as shown in the attached drawings, the present compactor basically includes a vibration generator 1 shown in FIG. 1 and a travel control device 20 shown in FIG. 2 provided with a hydraulic servo valve mechanism for switching the direction of thrust generated by the vibration generator 1 to the device to forward or backward directions.

As shown in FIG. 1, the vibration generator 1 has a drive shaft 3 to which rotation is transmitted via a pulley 2 from an engine not shown, and a driven shaft 4 which is positioned parallel to the drive shaft 3. An eccentric rotor 5 is fixedly mounted on the drive shaft 3 and a similar eccentric rotor 6 is fixed axially to the driven shaft 4 in such a way that the phase may be varied relative to said eccentric rotor 5.

At the center of the driven shaft 4 is a driven gear 7 which is rotatable with the shaft 4 and fixed axially to prevent travel in the axial direction. The driven gear 7 is transmitted rotation from the drive gear 8 of the drive shaft 3. The driven gear 7 is provided with a spiral groove 10 on the inner wall of a boss 9 inclined with respect to the axis of the boss 9.

The driven gear 4 is shaped like an open barrel with elongated holes 11 cut on the opposing walls at the position of said driven gear 7 respectively along the axial direction. A piston rod 12 is inserted rotatably and movably in the axial direction inside the driven shaft 4.

The piston rod 12 has a boss 13 of a size to allow sliding inside the driven shaft 4 at one end and a piston 15 at another end via a bearing 16. On the outside of a vibrating case 17, one end of which is axially fixed, the driven shaft 4 is provided with a hydraulic cylinder 18 inserted with said piston 15.

In the boss 13 of the piston rod 12 is embedded a knock pin 19 to perpendicularly cross the axial direction of the rod 12, and both ends of the knock pin 19 are fit inside the spiral groove 10 on the inner wall of said driven shaft 4 through the elongated hole 11 of said driven shaft 4.

When rotation from the drive gear 8 is transmitted to the driven gear 7 with zero hydraulic pressure on the hydraulic cylinder 18 inserted with the piston 15 at one end of the piston rod 12, mechanical return force being pushed toward the right side of FIG. 1 is imparted to the piston rod 12 since both ends of the pin 19 are engaged with the spiral groove 10 on the inner wall of said driven shaft 4 through the elongated holes 11 of the driven gear 4 in the direction of incline of the spiral groove 10 and rotation of the driven gear 7. When the piston rod 12 moves toward the extreme right in the figure, the eccentric rotor 6 of the driven shaft 4 is rotated, for instance, to the positional phase either forward or backward relative to the eccentric rotor 5 of the driven shaft 4.

On the other hand, the hydraulic cylinder 18 inserted with the piston 15 at one end of the piston rod 12 is connected to one end of said travel control device 20 provided outside. When the piston rod 12 inside the driven shaft 4 receives mechanical return force to the right hand side by the spiral groove 10 of the driven gear 7 as shown in FIG. 2, the device 20 imparts resistance against said mechanical return force inside said hydraulic cylinder 18 by utilizing the pressure oil from an outside hydraulic pump 41, and also functions to push the piston rod 12 to the left (forward) side of FIG. 1 by overcoming said mechanical return force.

As shown in FIGS. 2 through 7, the device 20 is constructed with a push rod 22 inserted through a right chamber 21*a* at one end of the body 21 to connect the outer end thereof with a travel lever 23, a spool 24 inserted into the central chamber 21*b* to be moved by the push rod 22, and a piston 29 inserted into the left chamber 21*c* at the other end to be moved by the spool 24, and is further provided with a passage 45 on the vibration generator side connected to the hydraulic cylinder 18 of the vibration generator 1 inside the center chamber 21*b* provided with the above mentioned spool 24.

Figure 3:
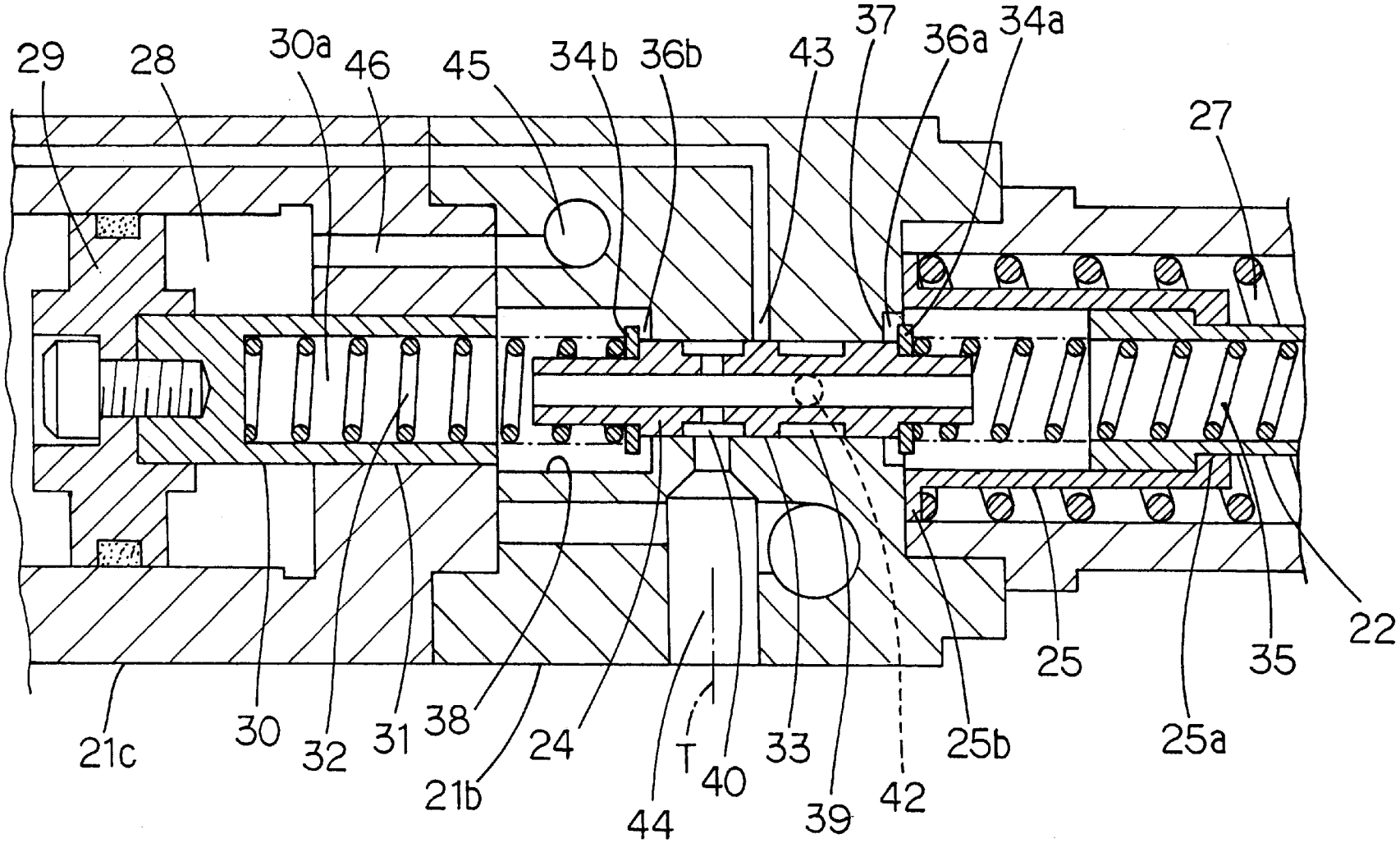
FIG. 3 is an enlarged sectional view of the center portion of FIG. 1.

As shown in FIGS. 2 and 3, the inside of the right chamber 21*a* of the body 2 is shaped like a cylinder 26, and the push rod 22 having a flange 22*a* at the inside end is inserted slidably therethrough. One end of the rod 22 provided with said flange 22*a* is also shaped like a cylinder 22*b*. Over the outer periphery on the left side of said push rod 22 are inserted a spring bearing 25 having a boss 25*a* engaged with the flange 22*a* at the right and a flange 25*b* abutting upon the inner wall of the center chamber 21*b* on the left. Between the left flange 25*b* of the spring bearing 25 and the right end of the cylinder 26 inside said right chamber 21*a* is inserted a spring 27 to support said push rod 22 in a neutral position.

There is provided a hydraulic cylinder 28 inside the left chamber 21*c* of said body 21 provided with a piston 29 inside. A rod 30 extending to the right side of the piston 29 is inserted in a freely slidable fashion into a bearing 31 provided on the side of the center chamber 21*b* of the left chamber 21*c*. The right end of the rod 30 facing the center chamber 21*b* is shaped as a cylinder 30*a* inside which is positioned a spring 32 with one end extending into the center chamber 21*b*.

On the other hand, a hole 33 connecting the right chamber 21*a* and the left chamber 21*c* on the same axis is bored in the center chamber 21*b* of the body 21, and the spool 24 is slidably positioned inside the hole 33. The portion between the flange 34*a* and the push rod 22 provided on the right hand side outer periphery of the spool 24 is supported by a spring 35 placed inside the cylinder 22*b* of the push rod 22. The portion between the flange 34*b* provided on the left side outer periphery of the spool 24 and said piston rod 30 is supported by the spring 32 positioned inside the cylinder 30*a* of said piston rod 30. Therefore, said spool 24 is supported by a uniform spring pressure at the prescribed center position of the center chamber 21*b* by the left spring 32 and the right spring 35.

As shown in FIG. 3, the length of the hole 33 inside the center chamber 21*b* for inserting the spool is slightly shorter than the distance between the flanges 34*a* and 34*b* provided on the left and the right outer peripheries of the spool 24, so that when the spool 24 is maintained at the prescribed center position of the center chamber 21*b* by the springs 32 and 35 on both sides, a short concave portion 37 is created with an interstice 36*a* between the right end of the hole 33 and the right flange 34*a* of the spool 24. Between the left end of the hole 33 and the left flange 34*b* of the spool 24 is provided a long concave portion 38 with the interstice 36*b* to allow entry of the right end of said piston rod 30.

A pair of concave grooves 39, 40 are provided with a prescribed interval at the center of said spool 24. Inside the hole 33 of the center chamber 21*b* inserted with the spool 24 is provided a passage 44 on the tank side connecting with a port T on the tank side of said hydraulic pump 41 positioned outside the body 21 at the position connecting with the left groove 40 of the spool 24. In said hole 33 is provided a passage 43 for oil pressure connecting the center chamber 21*b* to the left side of the piston 29 in the hydraulic cylinder 28 of the left chamber 21*c* at the center of the concave grooves 39, 40 of said spool 24.

Figure 4:
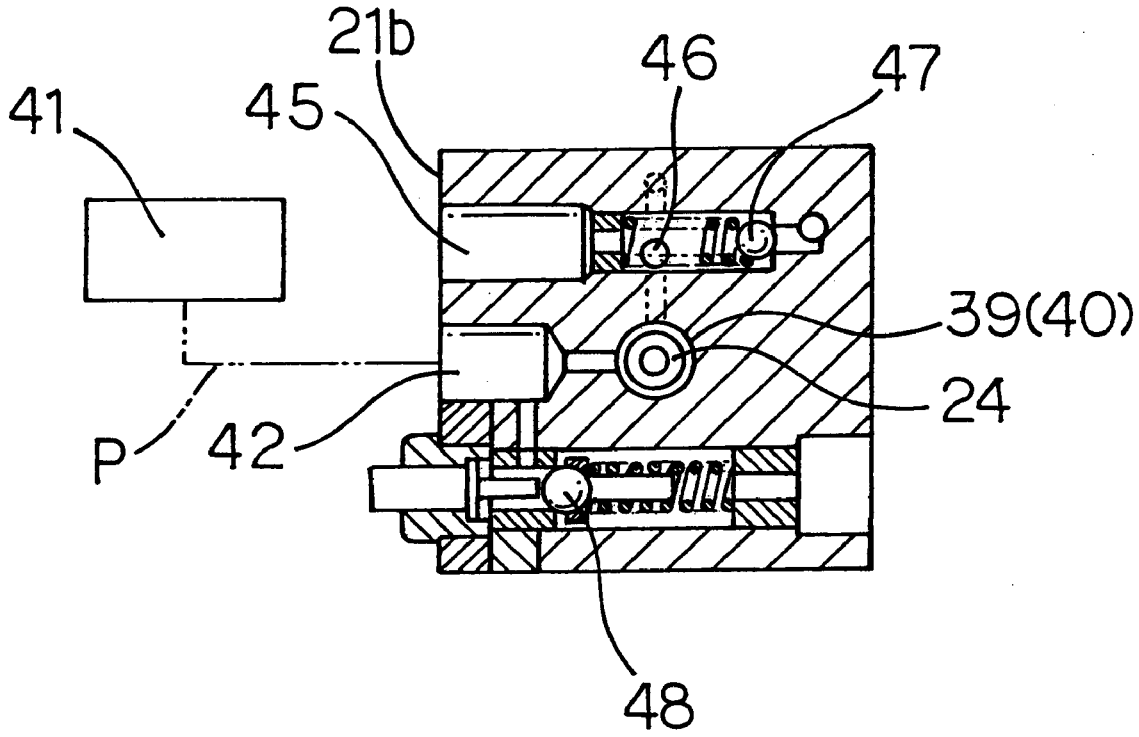
FIG. 4 is a sectional view along the line IV—IV in FIG. 2.

As shown in FIG. 4, but not in FIGS. 2 and 3, on the side of the pump is provided a passage 42 connecting to a pump side port P of said hydraulic pump 41 and extending from the side of the center chamber 21*b* toward the hole 33 at a concave groove 39 on the right.

As also shown in FIG. 4, there is provided at another part of the side of the center chamber 21*b* a passage 45 on the vibration generator side connecting with the hydraulic cylinder 18 of the piston rod 12 in said vibration generator 1, the passage being parallel to the pump side circuit 42 connecting with the pump side port P of the hydraulic pump 41. At the tip of the passage 45 is another passage 46 for oil pressure provided with a check valve 47 leading to the right side of the piston 29 in the hydraulic cylinder 28 through the left chamber 21*c* from the center chamber 21*b*.

The numeral 48 in FIG. 4 denotes a relief valve for discharging the air mixed in the hydraulic cylinder 18 of the piston rod 12 in said vibration generator 1.

When using a compactor as constructed above by maintaining the compactor in a neutral position, the lever 23 of the travel control device 20 is kept neutral as shown in FIG. 2. In this state, the spool 24 of the device 20 is supported at the center of the center chamber 21*b* by the spring pressure of the springs 32, 35 on the left and the right sides, and the passage 43 for supplying pressure to the left side of the piston 29 in the hydraulic cylinder 28 is between the concave grooves 39, 40 on the left and the right of the spool 24. The pump side passage 42 is therefore closed. The push rod 22 on the right side of the spool 24 receives the spring pressure toward right by the spring 35, but the spring pressure of the springs 27 and 35 attains an equilibrium because of the spring pressure toward left by the outside spring 27 of the outside spring bearing 25. Thus, the device maintains its neutral state even when the operator removes his/her hand from the lever 23 connected to the push rod 22.

The piston rod 12 of the vibrating plate generator 1 shown in FIG. 1 is positioned at the center of the driven shaft 4 at this time, but as the driven gear 7 continues its rotation, mechanical return force is imparted to the piston rod 12 toward the right hand side. As a result, the pressure oil inside the hydraulic cylinder 18 of the vibration generator 1 passes through the passage 45 on the side of the generator in the center chamber 21*b* of the device 20 and the passage 46 for oil pressure and flows to the right hand side of the piston 29 inside the hydraulic cylinder 28, to thereby push the piston 29 toward the left side of the hydraulic cylinder 28 from the position shown in FIG. 2.

When the piston 29 is pushed to the left, the spring pressure of the left spring 32 of the spool 24 becomes loosened, and the spool 24 moves toward the left by the spring pressure of the right spring 35. This movement of the spool 24 to the left is only for a short distance as the flange 34*a* on the right of the spool 24 abuts upon the edge of the short concave portion 37 at the right edge of the hole 33.

When the spool 24 moves toward left, the concave groove 39 connecting to the passage 42 on the right of the outer peripheral surface of the spool 24 becomes connected to the passage 43 connecting with the left side of the piston 29 of the hydraulic cylinder 28 to charge the oil from the pump side passage 42 of the hydraulic pump 41 to the left side of the piston 29 inside the hydraulic cylinder 28. As the oil amount gradually increases, the pressure on the left side of the piston 29 overcomes the force from the direction of the hydraulic cylinder 18 of said vibration generator 1 to push the piston 29 to the left, and pushes back the piston 29 to the right. The left spring 32 thus moves the spool 24 to the right. This move of the spool 24 to the right is only for a short distance as the flange 34*b* on the left side of the spool 24 abuts upon the end of the concave portion 38 of the hole 33.

When the spool 24 travels to the right, the pump side passage 42 again becomes positioned at the intermediate position of the left and right concave grooves 39, 40 as shown in FIG. 2, and blocks the flow of pressure oil from the pump side passage 42 to the left side of the piston 29 via the passage 43 for pressure oil. Oil from the passage 45 on the vibration generator side again flows through the passage 46 into the right hand side of the piston 29 to push the piston 29 back to the left side.

Figure 5:
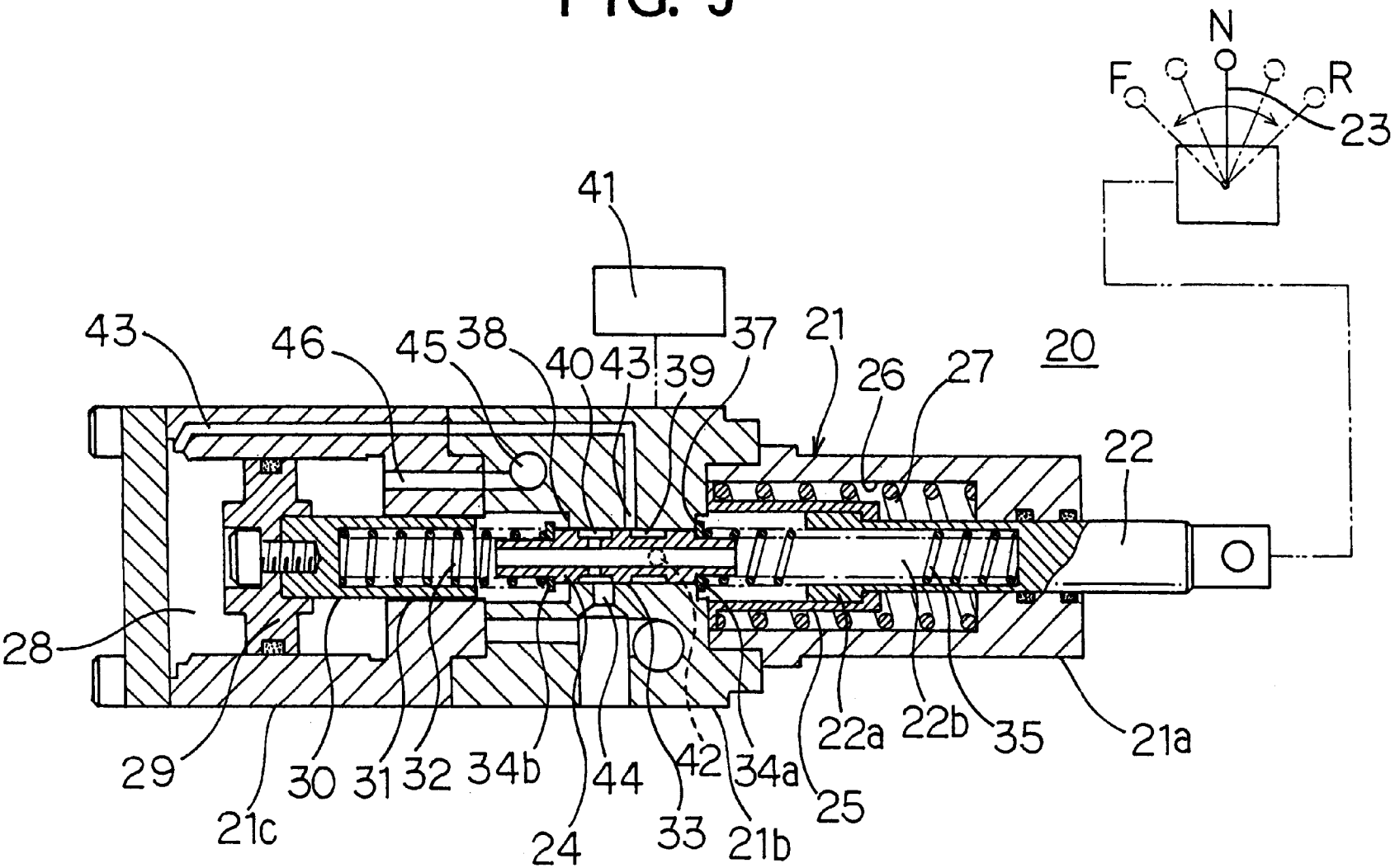
FIG. 5 is a sectional view of the travel control device in a neutral position with the circuit on the pump side open.

As a result of the above operation, when the lever 23 is set at a neutral position, the piston 29 is pushed toward the left in the hydraulic cylinder 28 by the mechanical return force from the passage 45 on the vibration generator side. As shown in FIG. 5, the spool 24 moves leftward and opens the pump side passage 42, and then the piston 29 is pushed back to the right by the oil from the passage 42. As shown in FIG. 2, the spool 24 then travels to the right to close the passage 42, and to push the piston 29 toward left by the mechanical return force from the passage 45. This movement is repeated automatically.

In this large-sized compactor weighing more than 500 kg, even if the powerful mechanical return force corresponding to the heavy weight from the vibration generator 1 pushed the piston 29 toward the left when operating the lever 23, the pump side passage 42 opens in the next instant to resist the mechanical return force.

Such movement of the piston 29 takes place at the center of the cylinder 28 as shown in FIGS. 2 and 5, and the pressure at the right of the piston 29 in the cylinder 28 is transmitted to the hydraulic cylinder 18 of the vibration generator 1 from the passage 45 to position the piston 15 of the piston rod 12 at the center of the hydraulic cylinder 18. This maintains the body in a neutral position. As shown in FIGS. 2 and 5, the push rod 22 is standing still at a position to maintain neutrality by the spring 27 outside of the spring bearing 25, so that it is not necessary to manually keep the lever 23 in the prescribed position in order to maintain the device in its safe and neutral position even when the operator removes his/her hand from the lever 23.

When moving the device from the neutral to the forward position, the lever 23 should be pushed until it reaches the fastest forward position in the left of the figure or be maintained at an arbitrary position for setting the speed between the neutral and fastest forward positions.

Figure 6:
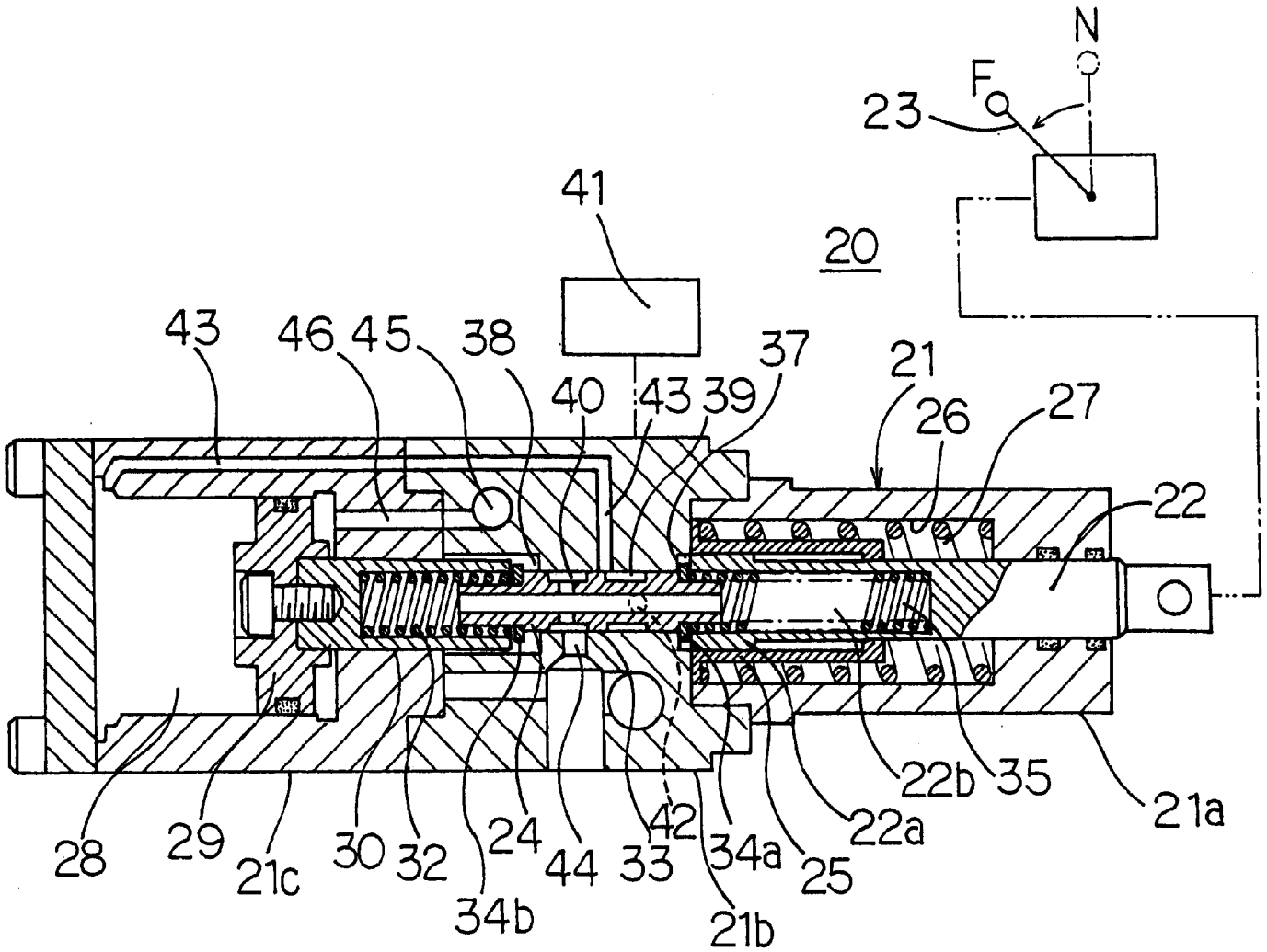
FIG. 6 is a sectional view showing the travel control device at its fastest forward speed.

When the lever 23 is kept pushing from the neutral position to the fastest forward position on the left side, the spool 24 is pushed to the left in the figure by the push rod 22, so that the pump side passage 42 opens the passage 43 and pushed the piston 29 to the right as shown in FIG. 6. As a result, the spool 24 is pushed to the right by the spring 32 and the passage 43 is closed by the passage 42 as shown in FIG. 2 and the pressure oil from the passage 45 on the vibration generator side flows to the right of the piston 29 inside the hydraulic cylinder 28.

Even when the oil from the passage 45 flows to the right side of the piston 29 inside the cylinder 28, the oil on the left side of the piston 29 stays as shown in FIG. 2 because the passage 43 is closed by the pump side passage 42 positioned midway of the two grooves 39, 40, and the piston 29 stays stationery because of the equilibrium reached by both sides. At this time, the lever 23 keeps pushing the push rod 22 to the left, and the spool 24 moves immediately to the left as shown in FIG. 6 to open the passage 42 on the side of the pump. The spool 24 repeats lateral movements while being pushed to the left by the push rod 22, to thereby increase the oil amount of the left side of the piston 29 in the cylinder and to move the piston 29 gradually to the left as shown in FIG. 6.

Such movement of the piston 29 takes place in the space to the right of the center of the cylinder 28, and as the pressure on the right side of the piston 29 in the cylinder 28 is transmitted from the passage 45 on the vibration generator side to the hydraulic cylinder 18 of the vibration generator 1, the piston 15 of the piston rod 12 moves to the left of said hydraulic cylinder 18 while resisting the mechanical return force to thereby advance the body of the device forward. Finally, the right end of the piston 29 moves to a position to abut upon the right edge of the left chamber 21*c* to achieve the fastest forward speed.

When the lever 23 is maintained at an arbitrary position before the fastest forward speed position, the device advances at a prescribed speed corresponding to the angle of inclination of the lever 23.

In other words, while the spring 35 on the right of the spool 24 is being pushed to the left by the push rod 22 by a prescribed force, the device advances as described above, but the spool 24 repeats the above mentioned lateral movement corresponding to the intensity of the force of the spring 35 which pushed the push rod 22 to the left. This increases the oil amount on the left rather than on the right of the piston 29 inside the cylinder 28, and this status is transmitted to the cylinder 18 of the generator 1 from the passage 45, to thereby advance the device at a predetermined speed.

Figure 7:
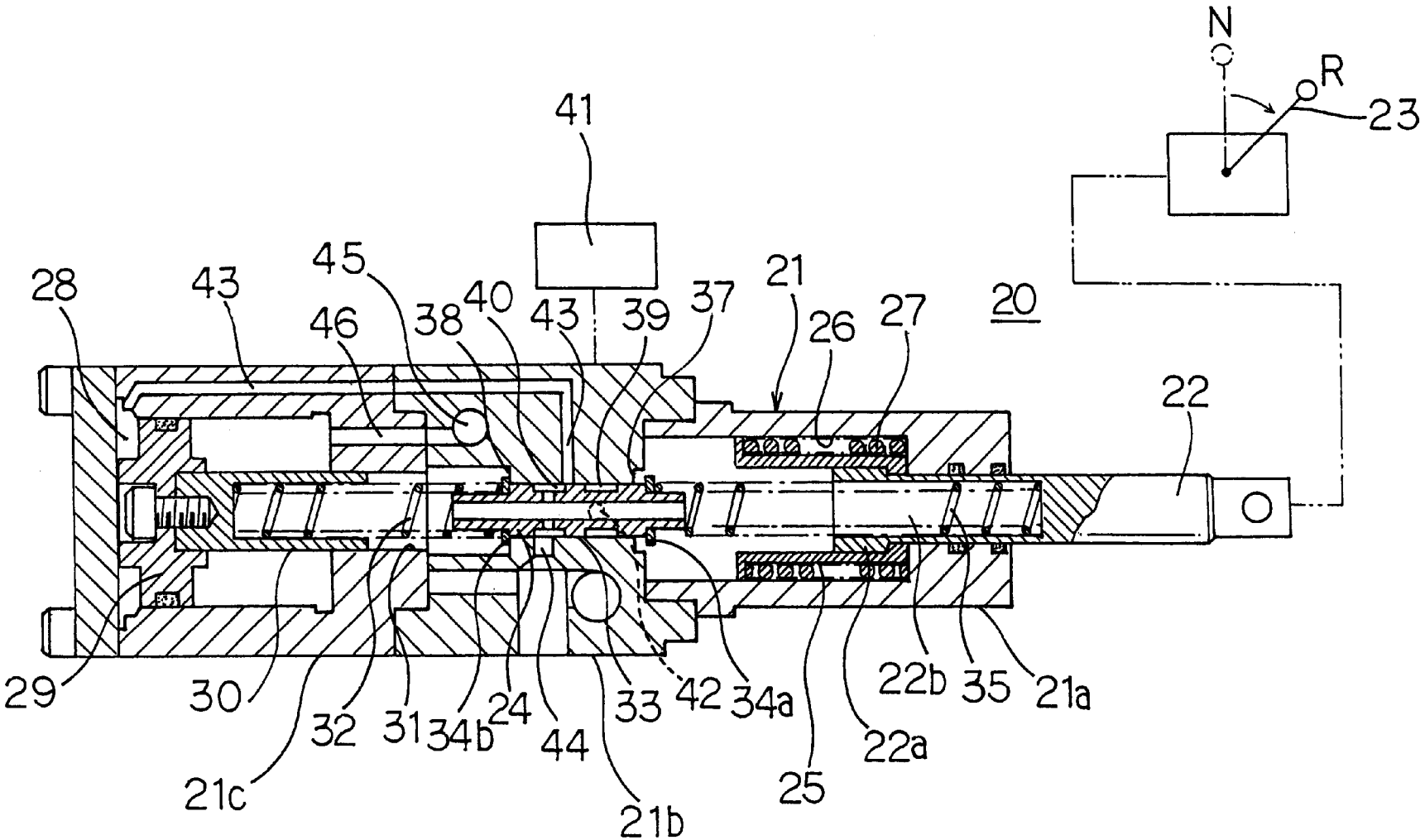
FIG. 7 is a sectional view showing the travel control device at its fastest backward speed.
Figure 8:
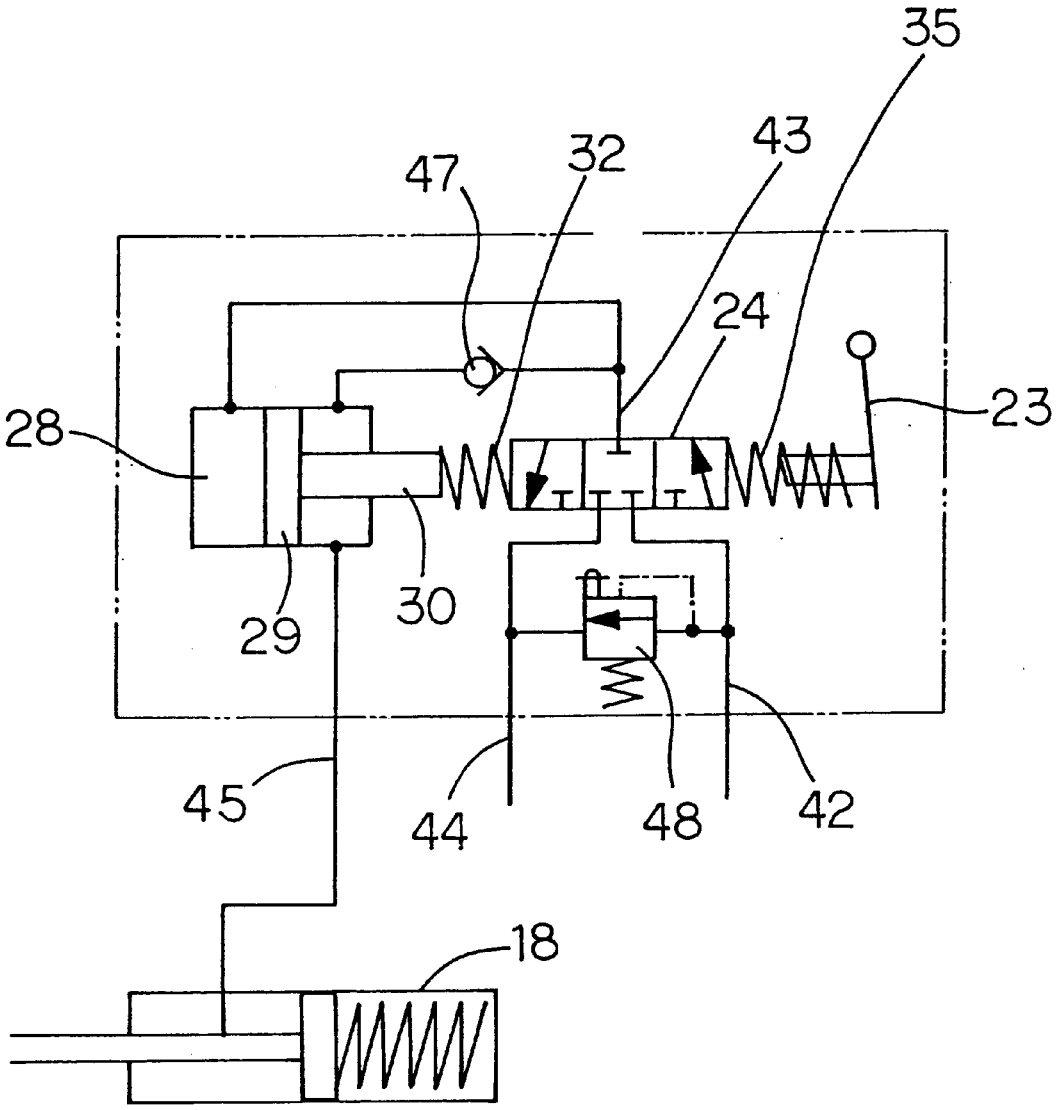
FIG. 8 is a hydraulic circuit diagram of the travel control device.

When the device is moved backward, the lever 7 is pulled to the fastest backward speed position to the right of the figure from the neutral position as shown in FIG. 7, or maintained at an arbitrary angle between the neutral position and the fastest backward speed.

If the lever 23 is pulled from the neutral position to the fastest backward speed position on the right, the push rod 22 is pulled to the right by resisting the pressure of the spring 27 on the outer periphery of the spring bearing 25 as shown in FIG. 7, and the spring force of the right spring 35 becomes lowered. This moves the spool 24 to the right and connects the left concave groove 40 with the passage 43, which is at this time cut from the pump side passage 42. Since the left groove 40 is connected with the tank side passage 44 leading to the port T on the tank side, the oil on the left of the piston 29 is discharged toward the tank from the passage 43 via the concave groove 40 and the passage 44 on the tank side.

When the oil on the left side of the piston 29 is discharged into the passage 44 on the tank side, the oil is supplied to the right side of the piston 29 from the passage 45 to push the piston 29 back to the left. This lowers the force of the spring 32 on the left of the spool 24 and moves the spool 24 to the left as shown in FIG. 2. The passage 43 is then closed to cut the flow to the tank side passage 44 and to stop the piston 29 by equilibrium achieved by pressure oil on both sides.

When the push rod 22 is kept pulling to the right, the force of the spring 35 on the right of the spool 24 becomes lowered and the spool 24 again moves to the right, the left groove 40 is connected with the passage 43, and the oil on the left of the piston 29 is discharged toward the tank from the groove 40 via the passage 44. As the oil flows into the right side of the piston 29 from the passage 45, the travel of the piston 29 and the spool 24 to the left to cut off the flow of the oil from the passage 45 is repeated. The piston 29 gradually moves to a position abutting upon the left end of the left chamber 21*c* to achieve the fastest backward speed.

When the lever 23 is held at an arbitrary position before reaching the fastest backward speed position, the device recedes at a prescribed speed corresponding to the angle of inclination of the lever 23.

In this state, the push rod 22 is pulled to the right and the force of the spring 35 on the right of the spool is lowered to cause the device to advance as discussed above. But the spool 24 repeats the above mentioned lateral movement corresponding to the intensity of the force of the spring 35 while the push rod 22 is pulled to the right. This increases the oil amount on the right side compared to that on the left side of the piston 29 in the cylinder 28, and this state is transmitted to the hydraulic cylinder 18 of the vibration generator 1 from the passage 45 to move the device backward while maintaining a prescribed speed.

FIGS. 9 through 14 show another construction of a travel control device 50 according to the second embodiment of the present invention. The device 50 consists of a piston 66 placed inside a cylinder 58 comprising a body 51, a push rod 52 manipulated by an outside travel lever 53 inserted into the left chamber 58*a* of the cylinder 58, and a spool 59 positioned in such a way to be inserted into the left side of the piston 66. In the right chamber 58*b* of the cylinder 58 on the right side of the body 51 is a passage 90 connecting with the hydraulic cylinder 18 of the vibration generator 1. At the center of the body 51 are a passage 60 on the pump side to connect with a hydraulic pump 55 and a passage 61 on the tank side.

Said piston 66 is provided with an elongated hole 63 along its axis at the right end thereof, through which is inserted a vertical barrel 65 crossing perpendicular with the axis of the piston 66. The piston 66 therefore moves laterally along the length of the elongated hole 63 without revolving inside the body 51. The vertical barrel 65 has orifices 64*a*, 64*b* and is connected at its top with the tank side passage 61. Inside the right chamber 58*b* of the cylinder between the right end of the piston 66 and a plug 56 closing the right end of the body 51 is positioned a spring 62.

Figure 10:
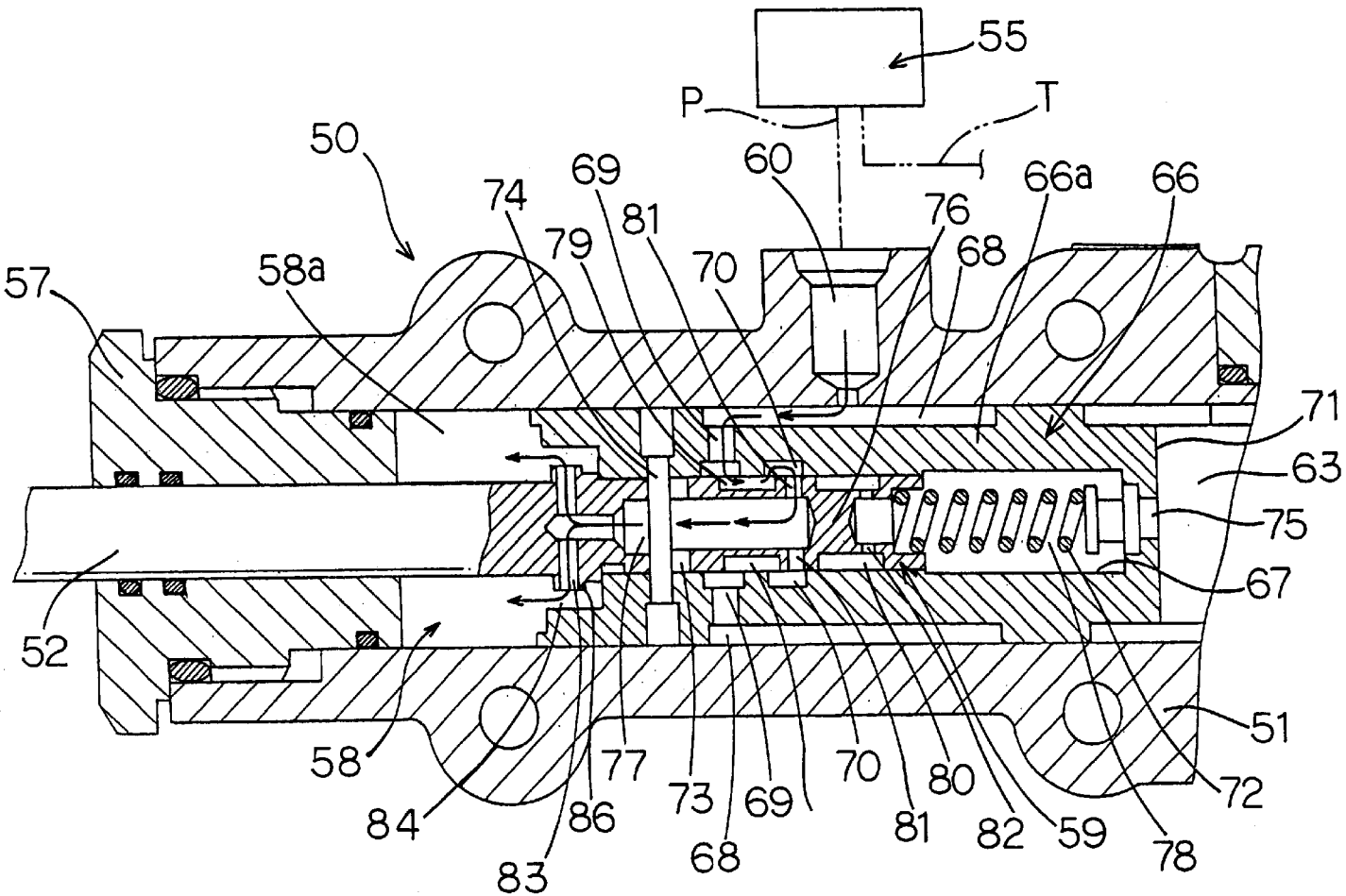
FIG. 10 is a sectional view showing the travel control device of FIG. 9 in a neutral position with the circuit on the pump side open.

As shown in FIG. 10, on the outer periphery of the left section 66*a* separated from the elongated hole 63 of said piston 66 are provided a long concave groove 68 to receive the oil from the pump side passage 60 of said hydraulic pump 55, an orifice 69 at the left end of the groove 68 to guide the oil from the groove 68 toward the outer periphery of the inner spool 59, and a short concave groove 70 on the inner periphery of the piston 66 on the right side spaced slightly apart from the orifice 69.

The above mentioned left section 66*a* of the piston has an orifice 75 on the right wall 71 and a short concave portion 84 having an inner diameter to allow insertion of a flange 86 between the push rod 52 and the spool 59 at the left end.

The spool 59, on the other hand, is provided at the end of the push rod 52 inserted into the left chamber 58*a* through the plug 57 closing the left end of the body 51, and is placed inside a cylindrical chamber 67 within the left section 66*a* of the piston. A spring 72 is provided between the right end of the spool 59 in the chamber 67 and the right wall 71 of the left section 66*a* of the piston to impart the force to the spool 59 to constantly push to the left. In the left of the spool 59 is a short elongated hole 73 along the axial direction of the spool 59 in which a pin 74 is fixed to the piston 66 at both ends of the hole to cross the axis of the spool 59 perpendicularly. The pin 74 stops the spool 59 from slipping out of the left section 66*a*.

Figure 11:
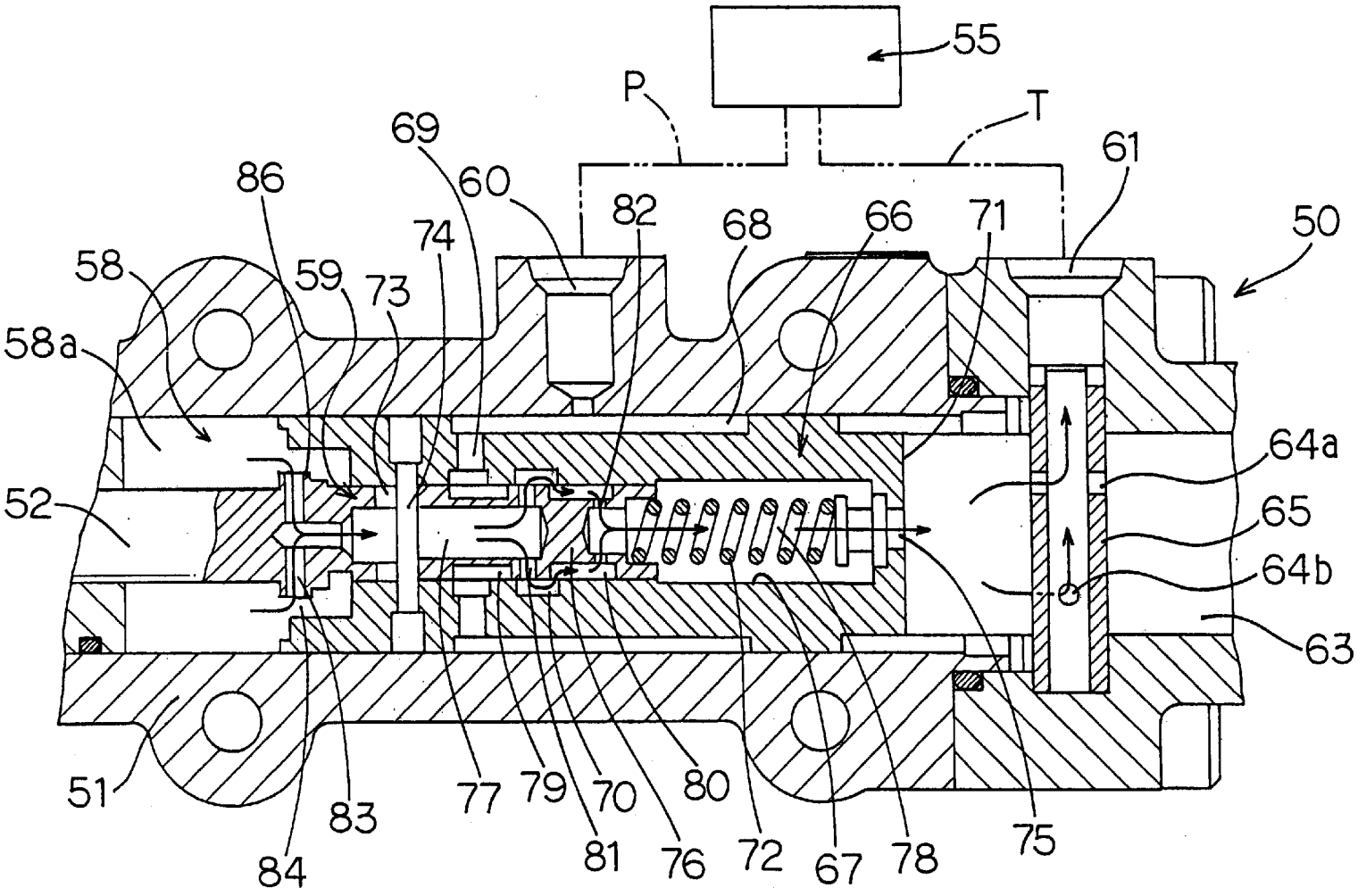
FIG. 11 is a sectional view showing the circuit on the tank side open.

As shown in FIGS. 10 and 11, there is provided a partition wall 76 to divide the inside of the spool 59 into passages 77, 78. A concave groove 79 is cut on the outer periphery of the spool 59 on the left side of the wall 76 and a concave groove 80 on the outer periphery of the spool 59 on the right side of the wall 76.

Between these grooves 79 and 80 on the outer periphery of the spool 59 is provided an orifice 81 to connect the groove 70 on the inner periphery of the left section 66*a* of the piston and the left passage 77 inside the spool 59. An orifice 82 is provided on the groove 80 on the outer periphery of the spool 59 connecting with the chamber 78 on the right side of the wall 76 in the spool 59. At the left end of the left passage 77 in the spool 59 is provided an orifice 83 connecting with the left chamber 58*a* of the cylinder on the left side of the piston 59 by passing through a flange 86 between the push rod 52 and the spool 59.

Figure 9:
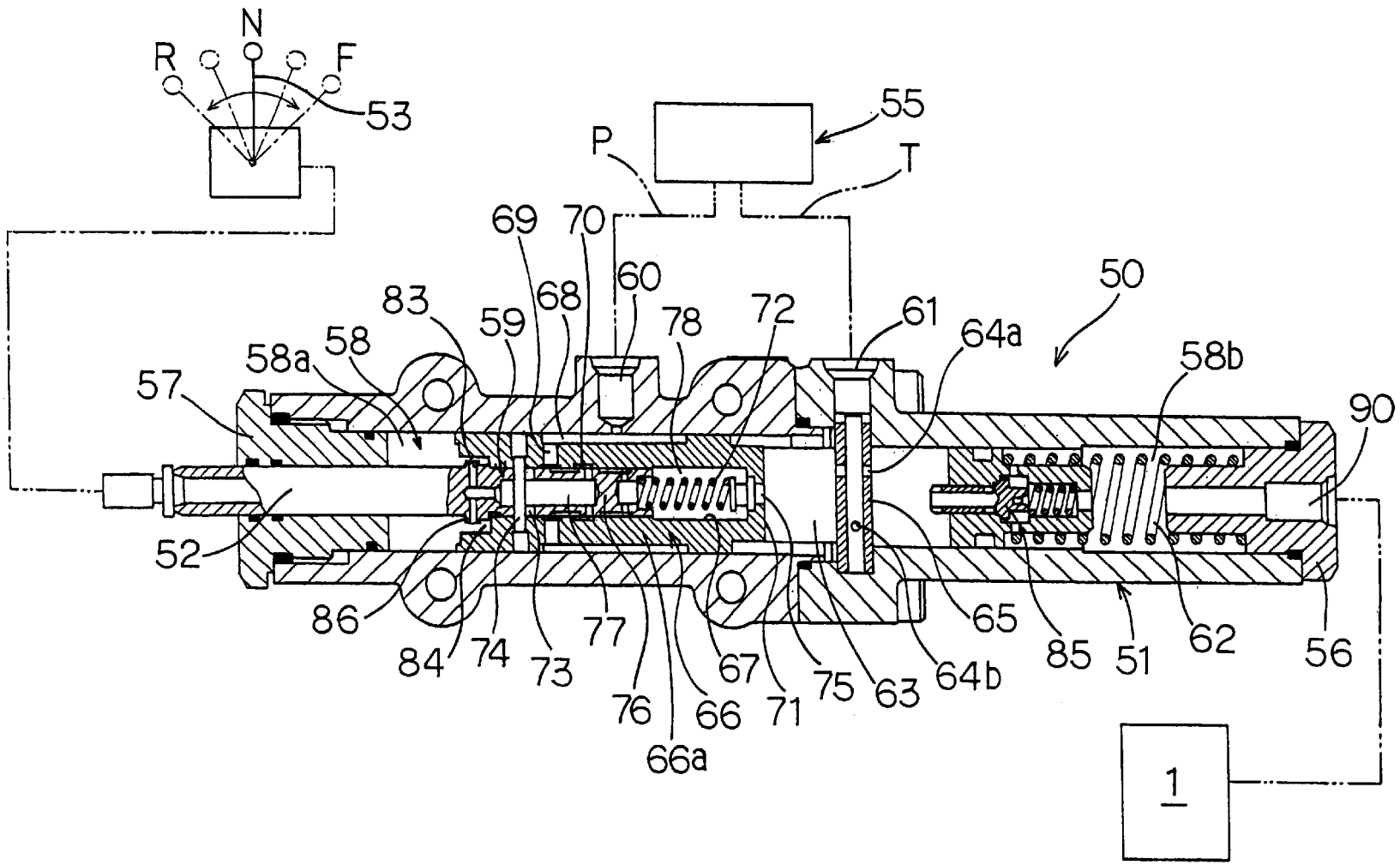
FIG. 9 is a sectional view showing construction of another embodiment of the travel control device.
Figure 12:
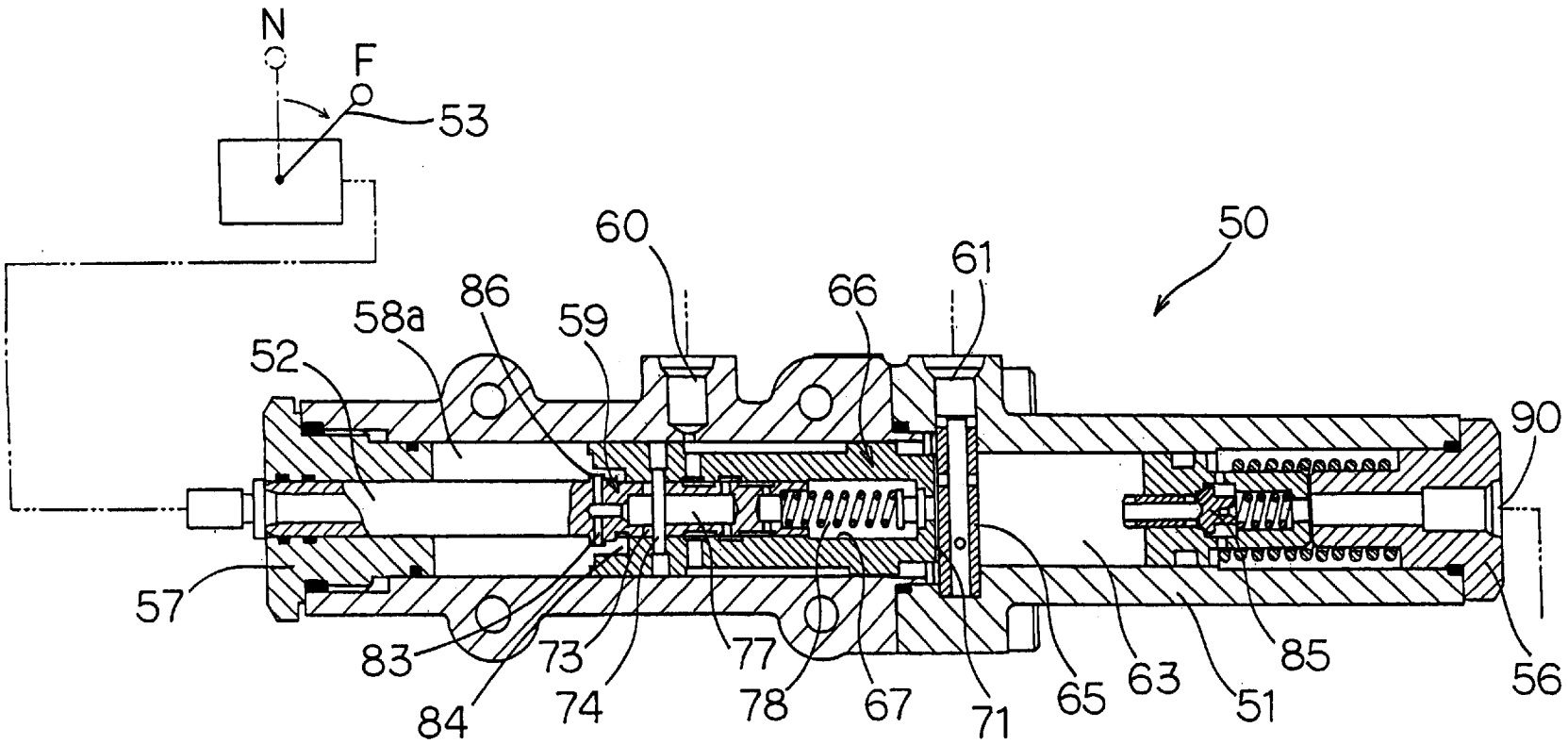
FIG. 12 is a sectional view showing the travel control device of FIG. 9 at its fastest forward speed.
Figure 13:
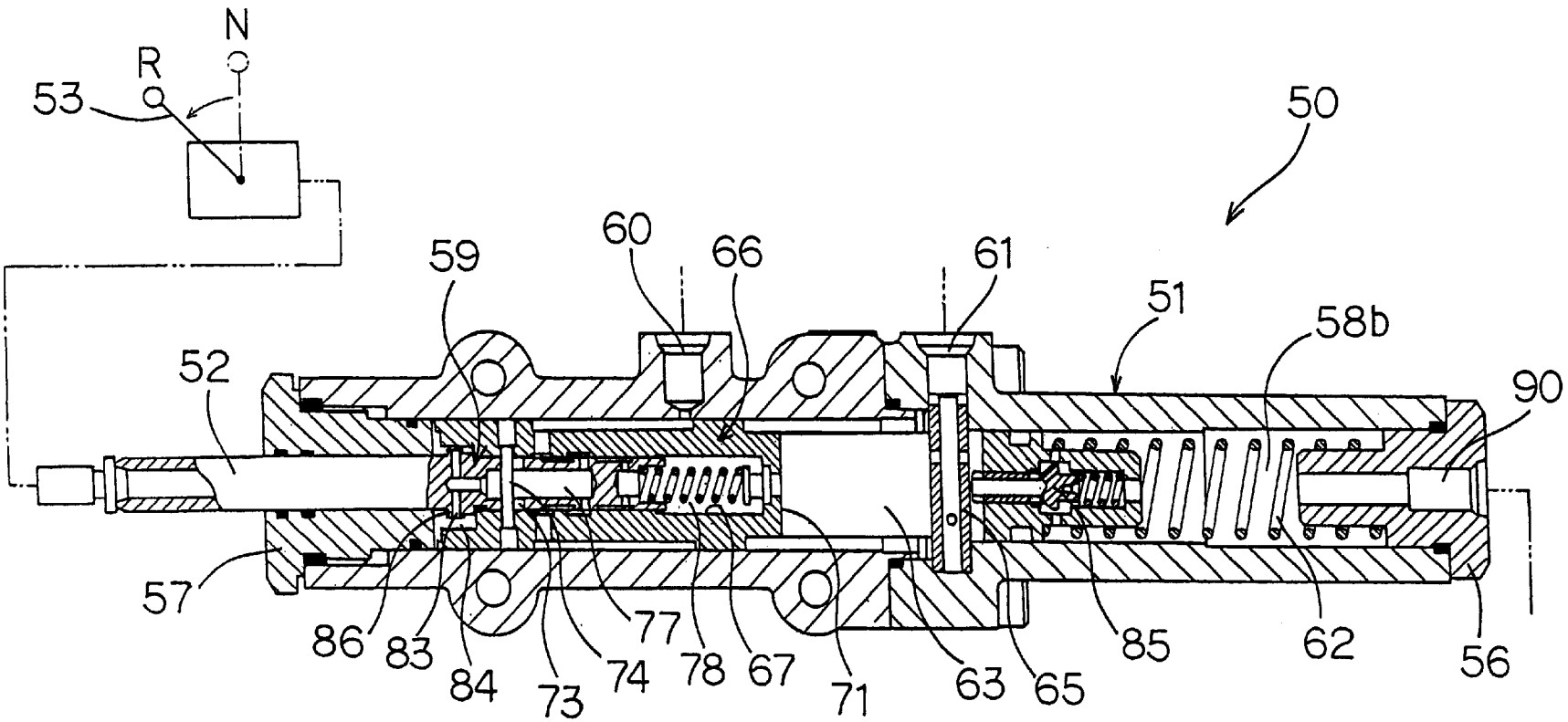
FIG. 13 is a sectional view showing the travel control device of FIG. 9 at its fastest backward speed.
Figure 14:
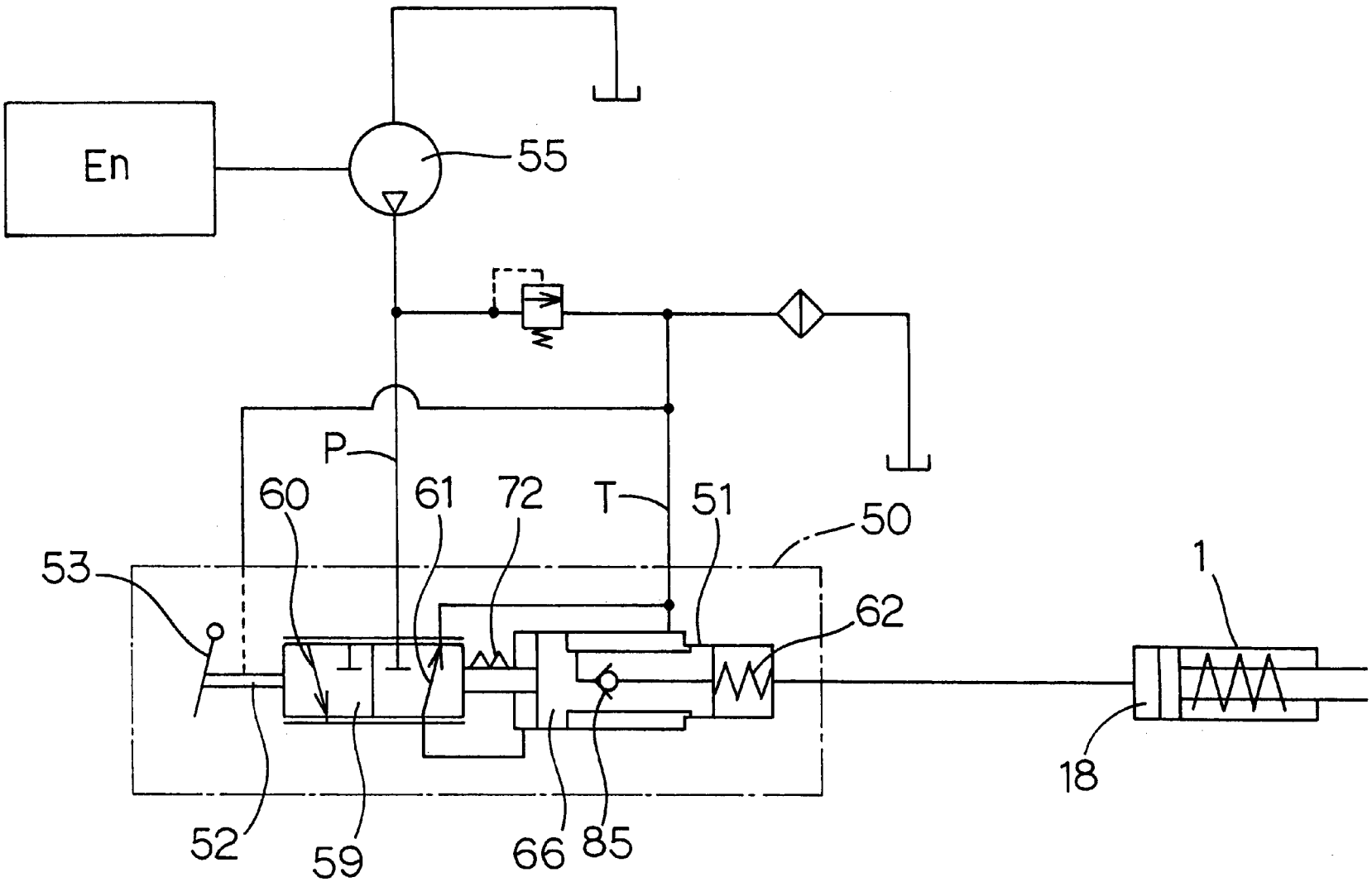
FIG. 14 is a sectional view showing the hydraulic circuit diagram for the travel control device shown in FIG. 9

On the other hand, at the right end of the piston 66 is provided a valve 85 as shown in FIGS. 9, 12 and 13. The valve 85 is closed when the piston 66 and the spool 59 travel to the right in the body 51 as shown in FIGS. 9 and 12, but when the piston 66 moves to the farthest left inside the body 51, it contacts said vertical barrel 65 and opens to release a part of the pressure oil in the right chamber 58*b* of the cylinder to the tank side passage 61 from the barrel 65.

In the travel control device 50 as constructed above, the travel lever 53 is set at the neutral position as shown in FIG. 9 when the device is to be maintained in the neutral state, and the position is held manually. The piston 66 is positioned at the intermediate point of the cylinder 58 at this time. In this state, the pressure oil receiving the mechanical return force of the vibration generator 1 is charged into the right chamber 58*b* of the cylinder on the right side of the body 51 through the passage 90. The piston 66 moves to the left by the pressure oil and the spring 62 as shown in FIG. 10, opens the circuit to charge the oil from the passage 60 on the pump side of the hydraulic pump 55 to the left of the piston 66, and the pressure increases inside the left chamber 58*a* of the cylinder.

The piston 66 is therefore pushed back to the right as shown in FIG. 11. In this state shown in FIG. 11, the oil from the left chamber 58*a* of the cylinder passes through the spool 59 to the tank side passage 61 of the hydraulic pump 55 from the barrel 65 and lowers the pressure inside the left chamber 58*a* on the left of the piston 66. The piston 66 is then pushed again toward the left by the oil charged into the right chamber 58*b* of the cylinder and the force of spring 62 as shown in FIG. 10.

When the travel lever 53 is set at a neutral position and the push rod 52 in a prescribed position, the piston 66 repeats the lateral movements discussed above at the intermediate portion of the cylinder 58 to thereby maintain the device in a neutral position.

When the device is to be moved forward from the neutral position, the travel lever 53 is pushed until the fastest forward position on the left side of the figure is reached or is maintained at an arbitrary angle for setting the speed prior to that position.

In this state, the spool 59 is pushed to the right by the push rod 52, or the circuit to charge the oil from the passage of the hydraulic pump 55 to the left side of the piston 66 opens as shown in FIG. 10, and the pressure inside the left chamber 58*a* of the left cylinder of the piston 66 becomes higher. As a result, the piston 66 is pushed back to the right as shown in FIG. 11, but since the push rod 52 is being pushed toward the forward direction (to the right) by the travel lever 53, the spool 59 is still on the right side while the oil from the passage 60 continues to flow into the left chamber 58*a* of the cylinder. As the oil amount in the left chamber 58*a* gradually increases and overcomes the amount of oil flowing into the right chamber 58*b* of the right cylinder on the right side of the body 51, the piston 66 moves to the fastest forward speed position on the extreme right in the cylinder 58 as shown in FIG. 12.

If the travel lever 53 is stopped at an arbitrary angle for setting the speed before reaching the fastest forward speed position, the piston 66 repeats the lateral movement as described above at the position with the spool 59 standing still at the end of the push rod 52.

When the device is brought backward from the neutral position, the travel lever 53 is pushed to the fastest backward speed position on the left side of the figure as shown in FIG. 13, or is maintained at an arbitrary angle for setting the speed prior to that position.

In this state, the spool 59 is pulled toward the left by the push rod 52, or the circuit to charge the oil from the left chamber 58*b* of the cylinder at the left of the piston 66 to the tank side passage 61 of the hydraulic pump 55 opens and the oil charged from the vibration generator 1 through the passage 90 increases the pressure inside the right chamber 58*b* of the cylinder on the right side of the piston 66. As a result, the piston 66 is pushed back to the left as in FIG. 10, but since the push rod 52 is being pulled toward the backward direction (to the left) by the travel lever 53, the spool 59 immediately moves to the left as shown in FIG. 11, and continues charging the oil from the left chamber 58*a* of the cylinder on the left side of the piston 66 to the tank side passage 61 of the hydraulic pump 55. The amount of oil flowing from the vibration generator 1 into the right chamber 58*a* of the cylinder through the passage 90 gradually becomes more than that flowing into the cylinder left chamber 58*a* from the pump side passage 60, to thereby move the piston 66 to the position of the fastest backward speed at the extreme left of the cylinder 58 as shown in FIG. 13.

When the travel lever 53 is stopped at an arbitrary speed setting angle before reaching the position of the fastest backward speed, the piston 66 repeats the lateral movement as described above with the spool 59 standing stationary at the end of the push rod 52, to bring the device backward at the prescribed speed.

Differences between constructions of the first embodiment shown in FIGS. 1 through 8 and the second embodiment shown in FIGS. 9 through 14 are that in the first embodiment the spool 24 is placed in the body 21 separate from the push rod 22 as if being sandwiched by the spring 35 between the push rod 22 and the spring 32 between the piston 29, while in the second embodiment the spool 59 is directly attached to the end of the push rod 52 without a spring between the push rod.

In the construction of the first embodiment, when the piston 29 is pushed to the left from the neutral position shown in FIG. 5 via the passage 45 by the oil charged from the vibration generator 1, the push rod 22 is separated from the spool 24 and supported by the spring 27 in the body 21 at a predetermined position, and the device is maintained in a neutral position even when the operator takes his/her hand off the travel lever 23. In the construction of the second embodiment, however, when the piston 66 is pushed to the left by the oil sent from the vibration generator 1 via the passage 90, the operator must hold the travel lever 53 by hand in order to prevent the push rod 52 from also moving to the left. The two embodiments are the same in respect of the rest of the basic construction.

As described above, the travel control device for the vibrating plate compactor according to the present invention is provided with a piston to receive the mechanical return force from the vibration generator in the cylindrical body on one hand, and a servo valve spool which can supply the pressure from the hydraulic pump to resist the mechanical return force acting on the piston by manipulating the push rod on the other, so that the device can supply the pressure to one side of the piston from the hydraulic pump to resist the powerful mechanical return force from the vibration generator even when the compactor is very large with its weight exceeding 500 kg, and the switching operation of the travel lever may be made lighter. It is also possible to control the speed at any position in the forward or backward directions with the travel lever in operation.

The construction of the first embodiment, in particular, provides a spool between the piston and the push rod via a spring in order to enable transmission of the force to operate the push rod to the spool via a spring and to further make the switching operation of the travel lever lighter. When the operator lifts his/her hand off the operating lever with the device in a neutral condition, the travel lever maintains its neutral condition automatically, thus enhancing safety by eliminating any risks of the device running out of control.

What is claimed is:

1. A vibrating plate compactor comprising:

first and second eccentric rotors on first and second parallel drive shafts which are operatively coupled together;

a piston rod slidably inserted into the first drive shaft which supports the first eccentric rotor;

a vibration generator having a hydraulic cylinder to switch rotation of said first and second eccentric rotors in one of a forward and backward direction, the hydraulic cylinder axially moving the piston rod by an outside force to resist a mechanical return force generated by rotation of said first and eccentric rotors; and a travel control device for imparting the outside force to the hydraulic cylinder, the travel control device including a piston which receives the mechanical return force from said vibration generator at one end and pressure oil from an outside hydraulic pump at an other end, a push rod operatively coupled to the piston for switching a travel direction, and a spool for a servo valve to supply the pressure oil from said hydraulic pump to the side of the piston opposite the side receiving the mechanical return force wherein the spool has first and second ends and is positioned at a central portion of the travel control device, both ends of said spool being supported by springs disposed between the push rod provided at one end of the travel control device and the piston at the other end of the travel control device, and a first passage on a vibration generator side of the travel control device to supply the mechanical return force from said vibration generator to a space between the spool and the piston, and a second passage on a pump side of the travel control device to supply the pressure oil from a hydraulic pump to oppose the mechanical return force between the spool and the outside of the piston.

2. The vibrating plate compactor as defined by Claim 1 wherein the travel control device further comprises a third passage supplying the pressure oil from the hydraulic pump through a concave groove cut on an outer periphery of the spool from the second passage by laterally moving the spool and manipulating the push rod, and a tank side passage to discharge the pressure oil from the third passage to a tank via another concave groove cut on the outer periphery of the spool.

3. A vibrating plate compactor comprising:

first and second eccentric rotors on first and second parallel drive shafts which are operatively coupled together;

a piston rod slidably inserted into the first drive shaft which supports the first eccentric rotor;

a vibration generator having a hydraulic cylinder to switch rotation of said first and second eccentric rotors in one of a forward and backward direction, the hydraulic cylinder axially moving the piston rod by an outside force to resist a mechanical return force generated by rotation of said first and eccentric rotors; and a travel control device for imparting the outside force to the hydraulic cylinder, the travel control device including a piston which receives the mechanical return force from said vibration generator at one end and pressure oil from an outside hydraulic pump at an other end, a push rod operatively coupled to the piston for switching a travel direction, and a spool for a servo valve to supply the pressure oil from said hydraulic pump to the side of the piston opposite the side receiving the mechanical return force wherein an inside of one end of the travel control device through which one end of the push rod is inserted is cylindrically-shaped, and the travel control device includes a spring bearing slidably inserted over an outer periphery of one end of the push rod, and a spring to support the push-rod in a neutral position over the outer periphery of the spring bearing.

4. The vibrating plate compactor as defined by claim 3 wherein one end of the push rod is a cylinder, and a spring is positioned between an end of the cylinder and one end of the spool positioned at the center of the travel control device.

5. A vibrating plate compactor comprising:

first and second eccentric rotors on first and second parallel drive shafts which are operatively coupled together;

a piston rod slidably inserted into the first drive shaft which supports the first eccentric rotor;

a vibration generator having a hydraulic cylinder to switch rotation of said first and second eccentric rotors in one of a forward and backward direction, the hydraulic cylinder axially moving the piston rod by an outside force to resist a mechanical return force generated by rotation of said first and eccentric rotors; and a travel control device for imparting the outside force to the hydraulic cylinder, the travel control device including a piston which receives the mechanical return force from said vibration generator at one end and pressure oil from an outside hydraulic pump at an other end, a push rod operatively coupled to the piston for switching a travel direction, and a spool for a servo valve to supply the pressure oil from said hydraulic pump to the side of the piston opposite the side receiving the mechanical return force wherein the spool is positioned in a central portion of the travel control device and has flanges at both ends thereof, a length of a hole through which said spool is inserted in the central portion is shorter than the distance between the flanges, and the travel control device further comprises a concave groove having a length corresponding to a length sufficient to allow inserted of one end of the piston rod extending toward the spool from the piston at one end of said hole on the side adjacent to the piston.

6. The vibrating plate compactor as defined by claim 5 wherein one end of the piston rod which extends toward the spool is shaped like a cylinder, and a spring is positioned between the one end of the piston and one end of the spool.

7. A vibrating plate compactor comprising:

first and second eccentric rotors on first and second parallel drive shafts which are operatively coupled together;

a piston rod slidably inserted into the first drive shaft which supports the first eccentric rotor;

a vibration generator having a hydraulic cylinder to switch rotation of said first and second eccentric rotors in one of a forward and backward direction, the hydraulic cylinder axially moving the piston rod by an outside force to resist a mechanical return force generated by rotation of said first and eccentric rotors; and a travel control device including a cylindrical body and imparting the outside force to the hydraulic cylinder, the travel control device including a piston which receives the mechanical return force from said vibration generator at one end and pressure oil from an outside hydraulic pump at an other end, a push rod operatively coupled to the piston for switching a travel direction, and a spool for a servo valve to supply the pressure oil from said hydraulic pump to the side of the piston opposite the side receiving the mechanical return force wherein the spool has an elongated hole at one end thereof through which a pin is inserted in a direction perpendicular to an axis of the spool so that the spool can reciprocally travel inside the piston for the length of the elongated hole in order to switch the pressure oil supplied from the pump side passage to the cylinder on a push rod side.

8. A vibrating plate compactor comprising:

first and second eccentric rotors on first and second parallel drive shafts which are operatively coupled together;

a piston rod slidably inserted into the first drive shaft which supports the first eccentric rotor;

a vibration generator having a hydraulic cylinder to switch rotation of said first and second eccentric rotors in one of a forward and backward direction, the hydraulic cylinder axially moving the piston rod by an outside force to resist a mechanical return force generated by rotation of said first and eccentric rotors; and a travel control device having a cylindrical body and imparting the outside force to the hydraulic cylinder, the travel control device including a piston which receives the mechanical return force from said vibration generator at one end and pressure oil from an outside hydraulic pump at an other end, a push rod operatively coupled to the piston for switching a travel direction, and a spool for a servo valve to supply the pressure oil from said hydraulic pump to the side of the piston opposite the side receiving the mechanical return force wherein a piston is disposed at one end of the cylindrical body having a passage to receive the mechanical return force from said vibration generator, and a push rod is integrally provided with the spool and inserted into an other end of the cylindrical body, with the spool being inserted into one end of the piston, and a pump side passage disposed between the piston and the spool to supply the pressure oil resisting said mechanical return force from a hydraulic pump outside the cylindrical body to the cylinder on the push rod side of the piston through said spool, wherein the spool has an elongated hole at one end thereof through which a pin is inserted in a direction perpendicular to an axis of the spool so that the spool can reciprocally travel inside the piston for the length of the elongated hole in order to switch the pressure oil supplied from the pump side passage to the cylinder on a push rod side.

* * * * *